United States Patent [19]

Bursh, Jr. et al.

[11] Patent Number: 4,510,346

[45] Date of Patent: Apr. 9, 1985

[54] SHIELDED CABLE

[75] Inventors: Talmage P. Bursh, Jr., Marietta, Ga.; Dean I. Davis; John T. Slominski, both of Omaha, Nebr.; Raymond K. Swartz, Lilburn, Ga.

[73] Assignees: AT&T Bell Laboratories, Murray Hill, N.J.; AT&T Technologies, Inc., New York, N.Y.

[21] Appl. No.: 538,067

[22] Filed: Sep. 30, 1983

[51] Int. Cl.[3] ..... H01B 11/06

[52] U.S. Cl. ..... 174/36; 174/106 R; 174/107; 174/115

[58] Field of Search ..... 174/36, 106 R, 107, 174/115

[56] References Cited

U.S. PATENT DOCUMENTS

| | | | |
|---|---|---|---|
| 581,715 | 5/1897 | Guilleaume | 174/113 R X |
| 1,871,906 | 8/1932 | Nyquist | 174/36 X |
| 1,933,261 | 10/1933 | Harris | 174/36 |
| 1,979,402 | 11/1934 | Nyquist | 174/36 X |
| 2,152,706 | 4/1939 | Mougey | 100/34 |
| 2,479,924 | 8/1949 | Gillis . | |
| 2,589,700 | 3/1952 | Johnstone | 174/106 |
| 3,011,933 | 12/1961 | Barnes et al. | 156/201 |
| 3,130,256 | 4/1964 | Mildner | 174/28 |
| 3,233,036 | 2/1966 | Jachimowicz | 174/36 |
| 3,274,329 | 9/1966 | Timmons | 174/36 |
| 3,321,572 | 5/1967 | Garner | 174/105 |
| 3,340,353 | 9/1967 | Mildner | 174/106 |
| 3,433,687 | 3/1969 | Price | 156/47 |
| 3,484,532 | 12/1969 | Anderson | 174/36 |
| 3,541,473 | 11/1970 | Schlicke et al. | 333/12 |
| 3,629,489 | 12/1971 | Jachimowicz | 174/107 |
| 3,643,007 | 2/1972 | Roberts et al. | 174/106 |
| 3,757,269 | 9/1973 | Baumgartner | 174/88 R X |
| 4,010,315 | 3/1977 | Mildner | 174/107 |
| 4,059,724 | 11/1977 | Ide | 174/36 |
| 4,109,099 | 8/1978 | Dembiak et al. | 174/107 |
| 4,221,926 | 9/1980 | Schneider | 174/107 |
| 4,292,463 | 9/1981 | Bow et al. | 174/107 |
| 4,308,662 | 1/1982 | Bohannon, Jr. | 29/828 |
| 4,327,246 | 4/1982 | Kincaid | 174/36 |
| 4,327,248 | 4/1982 | Campbell | 174/107 |
| 4,371,745 | 2/1983 | Sakashita | 174/115 |
| 4,374,299 | 2/1983 | Kincaid | 174/36 |
| 4,375,009 | 2/1983 | Fearnside | 174/36 |
| 4,376,920 | 3/1983 | Smith | 174/36 X |
| 4,383,225 | 5/1983 | Mayer | 174/36 X |

FOREIGN PATENT DOCUMENTS

| | | | |
|---|---|---|---|
| 1421796 | 1/1976 | United Kingdom | 174/106 R |

*Primary Examiner*—A. T. Grimley
*Assistant Examiner*—Morris H. Nimmo
*Attorney, Agent, or Firm*—E. W. Somers

[57] ABSTRACT

A cable which provides suitable shielding over a relatively wide range of frequencies includes a core (22), and inner shield (32), an outer shield (34) which engages electrically the inner shield, and a jacket (60). Each shield is a laminate which includes a metallic layer comprising a suitable metallic shielding material and a plastic layer. The inner shield has its plastic layer (38) disposed toward the core whereas the plastic layer (52) of the outer shield is oriented toward the jacket. Also, each shield is formed with an unjoined, longitudinal overlapped seam. In order to insure continued shielding when the cable is flexed, the longitudinal seams of the cable are displaced from each other as measured in a direction circumferentially of the core.

14 Claims, 8 Drawing Figures

Fig. 6
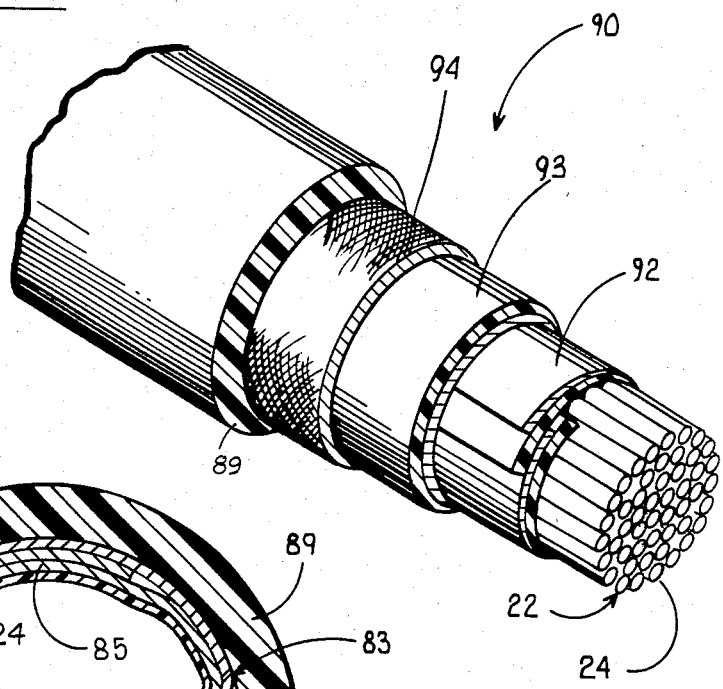
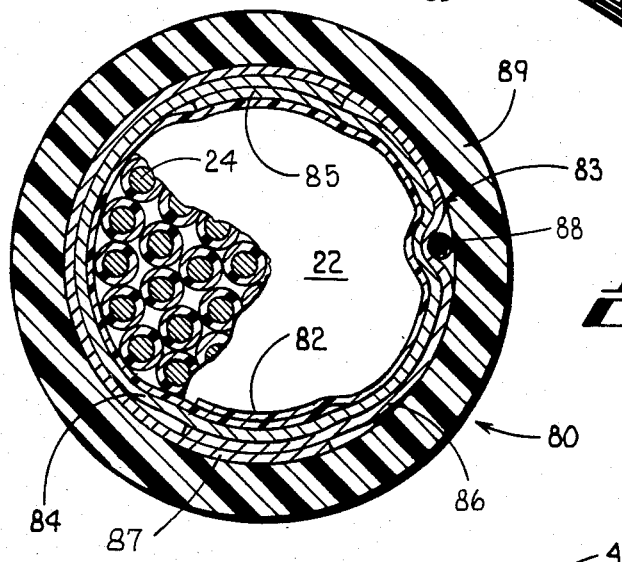
Fig. 5
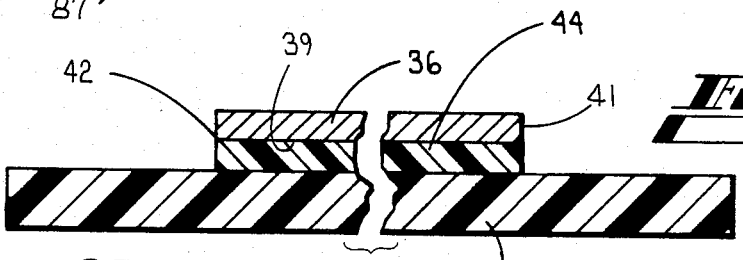
Fig. 3A
Fig. 3B
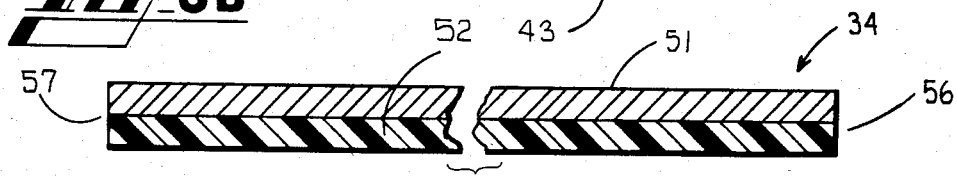

SHIELDED CABLE

TECHNICAL FIELD

This invention relates to a shielded cable. More particularly, it relates to a cable which is used for voice or data transmission and which has two metallic shields that provide effective shielding for the cable over a relatively wide range of operating frequencies.

BACKGROUND OF THE INVENTION

Shielding is an effective method of protecting communications cables from electrical and magnetic disturbances which arise from external sources and which result in noise, for example. The use of shielding, particularly for small pair size cables in which a relatively high signal to noise ratio is desirable, has increased greatly in recent years. These cables generally include a core comprising one or more signal carrying conductors and provisions for shielding the conductors from parasitic electrical and magnetic fields. Not only should the shielding prevent external disturbances from adversely affecting the signal being carried by one or more of the core conductors, but also it is intended to prevent the leakage of energy from the core to the environment.

Conventionally, shielding has been in the form of a suitable metallic braiding which has been woven about the core or a suitable metal foil which has been wrapped spirally thereabout. These kinds of shielding are discussed by Henry W. Ott in his book entitled "Noise Reduction Techniques in Electronic Systems" which was published by John Wiley and Sons in 1976 and which is incorporated by reference hereinto.

Metallic braiding is relatively expensive and its use causes a diameter buildup which may be larger than desirable in particular applications. Also, it provides less than full coverage of the core and is less effective than a foil-type shield, particularly at higher frequencies. The braided shield, which has been relied on by some concerns in the field, requires the use of a relatively low line speed during the application of the braid to the core.

Generally, the metal for foil-type shields is faced with a plastic material such as MYLAR ® plastic film which is used to strengthen the relatively thin metal and allow it to be processed. When such a material is wrapped about a cable core and overlapped, metal-to-metal contact at the overlapped seam is absent. This detracts from the shielding capability of such an arrangement.

The problem of insuring metal-to-metal contact of portions of the shield has been overcome in at least one prior art small pair size shielded cable. A longitudinal seam in a metallic-plastic foil laminate is formed by bending one longitudinal edge portion into a retroflexed configuration to engage the metallic portion of the one longitudinal edge portion of the laminate with the metallic surface of an opposing longitudinal edge portion. Although this arrangement provides metal-to-metal contact at the seam, it is expensive to manufacture because of the special forming of the one longitudinal edge portion.

Although the problem of metal-to-metal contact at the seam of longitudinally seamed, small pair size foil-shielded cables has been overcome, there use is not widespread. It has been believed that a longitudinally seamed cable requires the shield to be corrugated to prevent buckling. To be corrugated, the shielding material must have a thickness greater than that necessary for the shielding function. Accordingly, to avoid a somewhat bulky cable, some concerns have chosen not to use a longitudinally seamed shield.

A further problem that has arisen with the prior art braided and foil-types of shields has been the adverse effect on shielding caused by the cable having been flexed. Flexing which occurs, for example, when the cable is routed in the field causes tension and compression in different portions of the cable cross-section. Should an overlapped seam of a longitudinally seamed cable coincide with a plane of tension when the cable is flexed, the seam portions will tend to separate thereby providing a leakage path for energy from external sources and from the cable to the environment. This results in a diminution of the shielding capability of the cable.

Some use has been made of a helically wound shield for a frequency in the range of about 1 megahertz (MHz). For example, the prior art includes U.S. Pat. No. 3,274,329 which discloses a cable having a pair of spirally wrapped shields. Although flexing is not troublesome to this arrangement, a spirally wrapped shield is more difficult to terminate than one which is longitudinally wrapped about a core. Also, the spiral wrapping of the shields to stagger the overlapping portions is difficult to control from a manufacturing standpoint.

Although spirally wrapped foil is a less expensive type of shielding than braid, it has a limited effectiveness at relatively high frequencies. Frequency ranges substantially above 1 MHz are commonplace today in applications such as in private branch exchanges and in pulse clocks associated with electronic equipment. For these frequencies, leakage occurs in the commercially available foil-type shields, whether spirally or longitudinally applied. As the demand for so-called electronic wiring increases, it becomes necessary to be able to manufacture cables which provide suitable shielding over a wide frequency range.

It appears that the prior art is lacking in a cable which provides shielding against external disturbances over a relatively wide frequency range. Further, there doesn't appear to be an economical shielding arrangement which has substantial integrity notwithstanding the flexing of the cable.

SUMMARY OF THE INVENTION

The problems of the prior art have been overcome by the shielded cable of this invention. The cable includes a core comprising at least one conductor, a dielectric material which encloses the core, an inner shield, an outer shield and a plastic jacket. The inner shield encloses the core, has an unjoined longitudinal overlapped seam, and is made of a suitable metallic shielding material. It is to be understood that the metallic shielding material is suitable for protecting the cable against electromagnetic interference, which is a term commonly used to cover interference resulting from electrical and magnetic fields, and for preventing the cable from providing unwanted energy to the environment. As for the outer shield, it encloses and is in electrical engagement with the inner shield and it also is made of a suitable metallic shielding material. The outer shield has an unjoined, longitudinal overlapped seam which is displaced sufficiently from the seam of the inner shield in a direction circumferentially of the core to insure that the cable will be shielded as the cable is routed in a path in which portions of the cable cross-section are in tension and others are in compression.

In a preferred embodiment, each shield comprises a laminate having an aluminum layer and a plastic layer such as for example polyester plastic. The inner shield is disposed about the core to cause the plastic layer to be oriented toward the core whereas the plastic layer of the outer shield is oriented toward the jacket. Generally, the plastic layer, which acts as a carrier, is relatively thick compared to the aluminum layer in order to facilitate processing of the metallic material. Also, a plastic layer of the inner shield is extended beyond the metallic layer. As a result, when the inner shield is wrapped about the core, the extending plastic layer acts as a buffer between the metallic layer and the core. The shields are formed about the core to cause the seam of the inner shield to be displaced about 180° from the seam of the outer shield.

BRIEF DESCRIPTION OF THE DRAWINGS

Other features of the present invention will be more readily understood from the following detailed description of specific embodiments thereof when read in conjunction with the accompanying drawings, in which:

FIGS. 3A and 3B are detail views of metallic-plastic laminates which are used to form inner and outer shields, respectively, for the cable of FIG. 1;

FIG. 5 is an end view in section of another embodiment of the cable of this invention;

FIG. 6 is a perspective view in section of still another embodiment of a cable of this invention.

DETAILED DESCRIPTION

Figure 1:
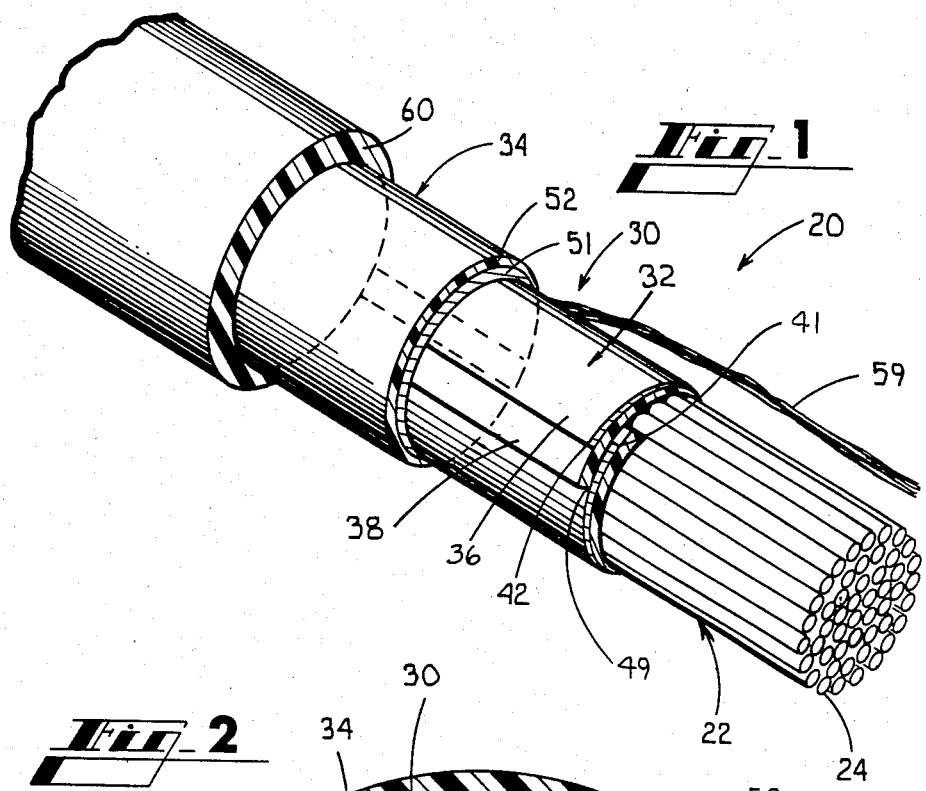
FIG. 1 is a perspective view of a shielded cable of this invention.
Figure 2:
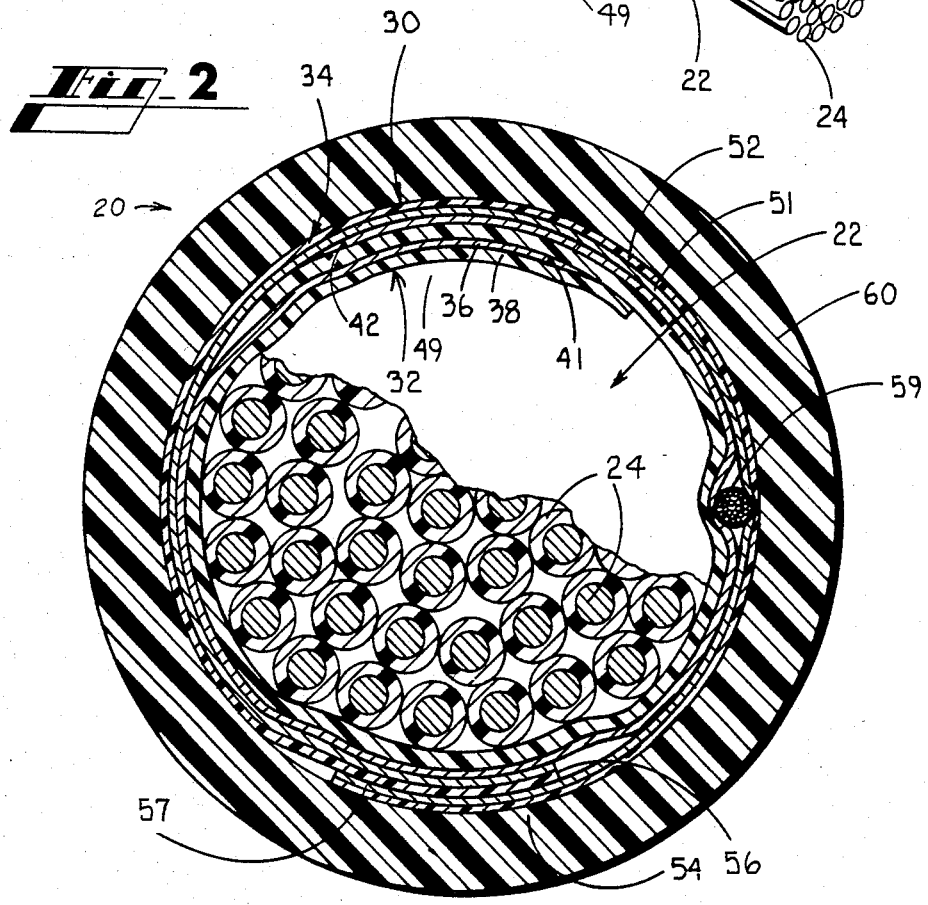
FIG. 2 is an end cross-sectional view of the cable of FIG. 1.

Referring now to FIGS. 1 and 2 there is shown a cable which is designated generally by the numeral 20. The cable 20 includes a core 22 which, typically, comprises a plurality of pairs of insulated conductors 24—24, which may be 26 gauge, for example. Generally, the number of pairs does not exceed one hundred. Although not shown as such in the drawings, the conductors 24—24 of a pair are usually associated by twisting. Each of the conductors 24—24 is insulated with a plastic material such as polyvinyl chloride (PVC), for example.

In order to protect the cable 20 from external parasitic disturbances and to prevent emission of electrical disturbances to the environment over a relatively wide range of frequencies, the cable is provided with a shielding arrangement 30. The arrangement 30 of this invention which includes inner and outer shields 32 and 34, respectively, provides shielding having substantial integrity.

The shield 32 is a laminate comprising an uncorrugated metallic layer 36 and a plastic layer 38 which is used to insulate the core and as a carrier to facilitate processing of the metallic layer. In order for the plastic layer to have sufficient strength to be processed, it usually must have a thickness which is greater than that of the metallic layer. Accordingly, in a preferred embodiment, the plastic layer 38 for the inner shield 32 has a thickness of about 0.003 inch compared to 0.001 inch for the metallic layer. In a preferred embodiment, the metallic layer 36 comprises aluminum and the plastic layer a polyester plastic material such as a MYLAR ® plastic material.

It is also a feature of this invention that the plastic material covers not only a major surface 39 (see FIG. 3A) of the metallic layer 36 but also is extended beyond longitudinal edge surfaces 41 and 42 of the metallic layer as well. This results in so-called foil-free edges of the shield 32 and prevents any contact between the metallic portion of the conductors 24—24 through insulation faults and the shield.

One approach for providing a laminate in which the plastic material extends beyond the longitudinal edges 41 and 42 of the metallic layer 36 is to laminate a plastic layer 43 to a laminate comprising the metallic layer 36 and a plastic layer 44 (see FIG. 3A). Both layers of the laminate comprising the metallic layer 36 and the plastic layer 44 have the same width which is less than that of the plastic layer 43. In a preferred embodiment, the metallic layer 36 and the plastic layer 44 each have a thickness of 0.001 inch whereas the thickness of the layer 43 is 0.002 inch. Although the plastic layer 43 is extended beyond both longitudinal edge surfaces 41 and 42 of the metallic layer in the preferred embodiment, it may be extended only beyond that edge surface which is adjacent to the core 22.

The inner shield 32 is wrapped about the core 22 to provide a longitudinal overlapped seam 49. The seam 49 has a width in the range of about 0.125 to 0.25 inch for a twenty-five pair size cable. Also, it should be observed that the shield 32 is wrapped about the core 22 to cause the plastic layer 38 to be oriented toward the core (see FIG. 2). The seam 49 is unjoined and the overlapping edge portions of the inner shield 32 are free to slide relative to each other in a circumferential direction.

Viewing again FIGS. 1 and 2, it is seen that the outer shield 34 also is a laminate comprising a metallic layer 51 and a plastic layer 52. In a preferred embodiment, the metallic layer 51 comprises uncorrugated aluminum and the plastic layer comprises a polyester plastic material such as a MYLAR ® plastic material which is used as the carrier for the metallic layer. Also in a preferred embodiment, the plastic layer 52 of the outer shield 34 has a thickness of 0.002 inch whereas the aluminum has a thickness of 0.001 inch. For the outer shield 34, it is unnecessary for the plastic layer 52 to extend beyond the longitudinal edges of the metallic layer 51 (see FIG. 3B).

The outer shield 34 is wrapped about the core 22 to provide a longitudinal overlapped seam 54. The seam 54 which has a width in the range of about 0.125 to 0.25 inch for a twenty-five pair cable is unjoined and its overlapped edge portions 56 and 57 also are free to slide relative to each other in a direction circumferentially of the core. Also, the outer shield 34 is wrapped in a manner to cause the plastic layer 52 to be oriented outwardly. As a result of the orientation of the metallic layers 36 and 51 of the inner and outer shields 32 and 34, respectively, the shields are in electrical engagement with each other have a substantial portion of their adjacent peripheral surfaces.

The metallic material of the layer 36 of the inner shield 32 and of the metallic layer 51 of the outer shield 34 each must be a suitable metallic shielding material and must have a predetermined conductivity, which generally is relatively high. This characteristic depends on the needs of the particular shielding system in its use. Further, the metallic materials which comprise the inner and the outer shields 32 and 34 may be the same or they may be different.

The cable 20 also includes a drain wire 59 (see FIGS. 1 and 2) which is a stranded wire and which is disposed between the two shields. The drain wire 59 is used to ground the shielding system. It is positioned between the two shields so that it is disposed angularly between the two seams. If too close to the longitudinal seam 49 of the inner shield 32, it could be moved through that seam into the core 22. If too close to the longitudinal seam 54 of the outer shield 34, it could be moved through it and become disposed between the outer shield and any outer covering. In either case, the drain wire 59 would not be functioning in the intended manner to ground each shield by being in metal-to-metal contact with each.

The dual shielded core 22 also is provided with a plastic jacket 60. The jacket material may be a polyvinyl chloride (PVC) plastic material for example. Generally, it has a thickness of about 0.015 to 0.025 inch.

It is also important that the plastic material which comprises the carrier for each shield be such that it not adhere to the jacket 60. The resulting non-bonded sheath system allows ease of strippability of the jacket from the shields. Further, movement between the jacket 60 and the shield system is permitted.

As will be recalled, the cable 20 may be flexed as it is routed through equipment, for example. This puts one side of the cable cross-section in tension and one side in compression at the points of flexing. Should there be just one shield, its seam, at locations where it coincides with a plane of compression, would tend to become further overlapped, while at others where it coincides with the plane of tension, it would tend to open. Further, twisting of the cable could induce torsional stresses which tend to further overlap or to separate the overlapped seam. In the event the longitudinal edge portions become moved apart, the core 22 becomes exposed and unprotected from the parasitic disturbances to which the shield is intended to offer protection.

In order to overcome this problem, the shields 32 and 34 are wrapped about the core 22 to control the location of the longitudinal overlapped seams. As is seen in FIG. 2, the longitudinal seam 49 of the inner shield 32 is displaced from the seam 54 of the outer shield 34 in a direction circumferentially of the core. In a preferred embodiment, the seams 49 and 54 are displaced 180°. Accordingly, if as in the worst situation, the cable 20 were to be flexed such that the shields 32 and 34 become aligned with the planes of tension and compression, the cable would still be shielded adequately. Shielding integrity continues to exist despite cable flexing because at the location where the one shield tends to open, the other shield which is not seamed spans across the opened seam.

It has been found that the expected buckling of the non-corrugated shields 32 or 34 does not degrade its shielding effectiveness. The use of a plastic-metallic laminate for each shield in the preferred embodiment and the freedom of the longitudinal edge portions of each shield to slide in a direction circumferentially of the core contribute to the ability of the shield to remain effective after having been flexed.

The shielding arrangement of small pair size cables for use in so-called electronic applications must be capable of protecting the core 22 at higher frequencies. At the lower frequencies, the mass of the shield is critical to shielding efficiency. As the transmission frequency increases, the amount of coverage of the core 22 by the shielding system becomes critical. Shielding, as will be recalled, is provided to keep radiation internal to the cable and to prevent external disturbances such as noise from affecting the transmission system.

A measure of the efficiency of a shielding system is a parameter referred to as surface transfer impedance. It is expressed in terms of ohms per length and is a measure of the gradient that exists across a shielding system once a current has been put on the inside of the shield. The lower the value of the surface transfer impedance, the more effective is the shield.

A graph 70 (see FIG. 4) has been constructed to show the shielding effectiveness of various kinds of shields over a range of frequencies. In the graph 70, the abscissa is the frequency and the ordinate is the surface transfer impedance, $Z_{ab}$, expressed in terms of dB which as used herein is a logarithmic unit expressing the ratio of the surface transfer impedance in ohms per mile to a reference value of one ohm per mile. A curve designated 71 represents an unflexed cable having a helically wrapped metallic foil with each turn being overlapped 50%. A curve designated 73 represents an unflexed cable having a braided shield, whereas curve 75 represents an unflexed cable which comprises a braided shield having 60% coverage disposed about a helically applied foil. Cables which include the shielding arrangement of this invention are represented by curves 76, 77 and 78. The curve 76 represents an unflexed cable, curve 77, a cable having experienced a number of cycles of hand flexing and curve 78, a cable with a greater number of cycles of hand flexing.

Figures 4, 7:
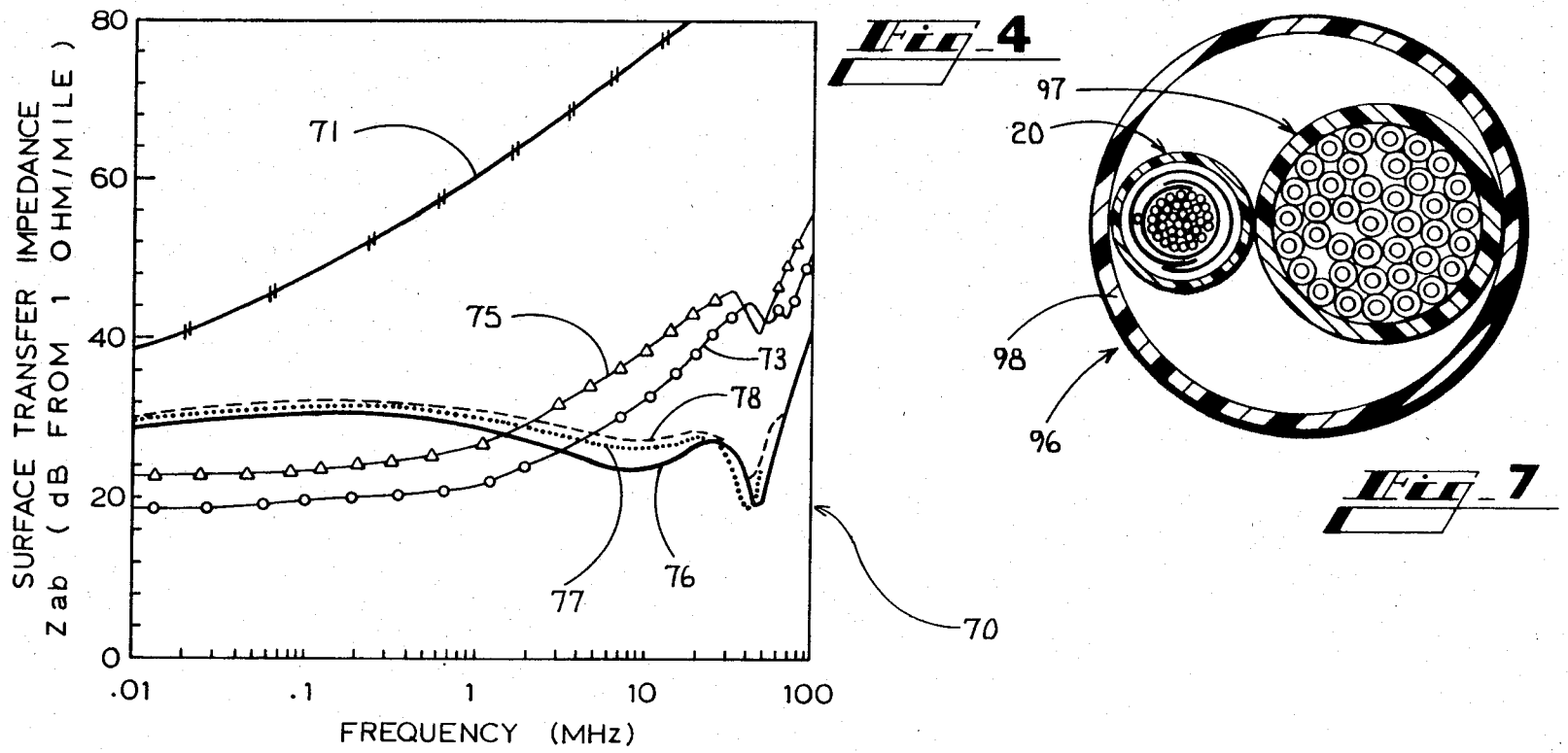
FIG. 4 is a graph which shows the effectiveness of various shields.
FIG. 7 is an end view in section of a cable which includes the shielded cable of FIG. 1.

As can be seen in FIG. 4, braided shields are better performers for frequencies below 1 MHz. For a transition range of from 1 to 10 MHz, longitudinally seamed shields become equivalent to braided shields in their performance whereas the longitudinally seamed shields appear to be more suitable for frequencies over 10 MHz. Generally, the shielding system 30 of the invention is characterized by a surface transfer impedance by less than 40 dB which herein equates to 100 ohms per mile at a cable frequency which is at least about 100 MHz. Numerous equipment now available in the marketplace use frequencies at the upper end of the transition range and beyond. Consequently, it becomes important that the surface transfer impedance be kept as low as possible for a wide range of frequencies.

The shielding arrangement of the cable 20 is also advantageous over that of prior art helically wrapped systems from the standpoint of termination and grounding. It becomes far easier to terminate a shield or to attach a grounding clamp such as that shown in U.S. Pat. RE No. 28,468, which issued on July 8, 1975 in the name of R. G. Baumgartner et al, for example, if the shield is wrapped longitudinally rather than helically about the core 22.

In the cable 20, which is the preferred embodiment, the metallic-plastic laminates are used to provide stability for the aluminum during processing. As was mentioned earlier, the thickness of the shield becomes less critical at the higher frequencies. Thus, if a metallic material having strength characteristics which allows it to be processed without deformation and having a cost which is within economic bounds is available, it could be used for each shield without resort to a plastic carrier. Of course, a dielectric core wrap is still required, otherwise the shield would short out the core 22 if there are any kinds of insulation faults.

Accordingly, under a suitable combination of economics, material strengths, and electrical system requirements, a cable 80 (see FIG. 5) would constitute another embodiment. The cable 80 includes the core 22, a core wrap 82 which comprises a dielectric material such as MYLAR® plastic film, for example, and a shielding system 83. The shielding system 83 includes an inner shield 84 which is formed about the core 22 to provide a longitudinal seam 85. An outer shield 86 which also is made of a metallic material is wrapped about the inner shield 84 to form a longitudinal overlapped seam 87. As before, the longitudinal overlapped seams 85 and 87 are spaced apart in a direction circumferentially of the core and a drain wire 88 is used to ground the shields. A plastic jacket 89 is extruded about the outer shield 86. Inasmuch as the metallic layers in this embodiment are not laminated with a plastic material, the drain wire 88 may be disposed between the outer shield 86 and the jacket 89.

It should be apparent that the invention also includes a cable 90 (see FIG. 6) which includes a longitudinally seamed, laminated inner shield 92, a longitudinally seamed, laminated outer shield 93 and a shield 94 which may comprise, for example, a braided metal or a helically applied foil. A jacket such as the jacket 89 encloses the shields. The braided metal is applied to the shields with commercially available braiders. Should the longitudinal seam of the inner shield 92 be flexed in tension to cause it to open, the braided shield 94 is complementary to the outer longitudinally seamed shield 93 and provides suitable shielding across any opening so caused.

In FIG. 7 there is shown a cable 96 which is still another embodiment of this invention. Therein, a shielded cable 20 of this invention together with another cable 97 or a cable core is enclosed in a jacket 98 of a plastic material.

It is to be understood that the above-described arrangements are simply illustrative of the invention. Other arrangements may be devised by those skilled in the art which will embody the principles of the invention and fall within the spirit and scope thereof.

What is claimed is:

1. A shielded cable, which comprises:

a core comprising at least one conductor;

a layer of dielectric material which encloses said core;

an inner shield which is disposed about said layer of dielectric material and which has an unjoined, longitudinal overlapped seam, said inner shield being made of a suitable metallic shielding material having a relatively high electrical conductivity;

an outer shield which encloses and which engages said inner shield, said outer shield comprising a suitable metallic shielding material which has a relatively high electrical conductivity and having an unjoined, longitudinally overlapped seam which is diametrically opposed to said seam of said inner shield to insure substantially continuous shielding of said cable; and a jacket which is made of a plastic material and which encloses said outer shield.

2. A shielded cable, which comprises:

a core comprising at least one conductor;

a shielding system which comprises:

an inner shield which encloses said core, which has an unjoined, longitudinal overlapped seam and which comprises a laminate of a plastic layer and a metallic layer of a suitable shielding material which has a relatively high electrical conductivity with the plastic layer being oriented toward said core; and an outer shield which is wrapped about said inner shield and which is in electrical engagement with said inner shield about a substantial portion of its circumference, said outer shield comprising a laminate of a metallic layer of a suitable shielding material which has a relatively high electrical conductivity and a plastic layer which is oriented outwardly from said core and having an unjoined, longitudinal overlapped seam which is diametrically opposed to said seam of said inner shield to insure substantially continuous shielding of said cable when said cable is flexed; and a jacket which is made of a plastic material and which encloses said outer shield.

3. The shielded cable of claim 2, wherein said shielding system is characterized by a surface transfer impedance which is less than about 40 dB from 1 ohm per mile at a cable frequency which is at least about 100 MHz.

4. The shielded cable of claim 2, wherein said metallic layers of said inner and outer shields are made of the same metallic material.

5. The shielded cable of claim 4, wherein the metallic layer of each of said shields comprises aluminum.

6. The shielded cable of claim 2, which also includes a stranded drain wire.

7. The shielded cable of claim 6, wherein said drain wire is spaced substantially from each of said seams.

8. The shielded cable of claim 7, wherein said drain wire is spaced equiangularly from said longitudinal overlapped seam of said inner shield and from said longitudinal overlapped seam of said outer shield.

9. The shielded cable of claim 2, wherein the plastic layer of the laminate of said inner shield overlaps at least one longitudinal edge surface of said metallic layer of said inner shield.

10. The shielded cable of claim 9, wherein the plastic layer of said inner shield includes a longitudinal edge portion adjacent to said core which extends beyond said metallic layer of said inner shield.

11. The shielded cable of claim 10, wherein the plastic layer of said inner shield overlaps the at least one longitudinal edge surface of said metallic layer of said inner shield a distance which is sufficient to preclude the engagement of the longitudinal edge surface of said metallic layer of said inner shield with said core.

12. The shielded cable of claim 9, wherein said inner shield comprises a laminate of a first plastic layer and a laminate comprising a metallic layer and a second plastic layer, said metallic layer and said second plastic layer being made of equal width strips of metallic and plastic materials and wherein said first plastic layer has a width which is greater than that of said second plastic layer.

13. The shielded cable of claim 12, wherein the total thickness of said first and second plastic layers of said inner shield is about three times that of said metallic layer of said inner shields.

14. The shielded cable of claim 2, which also includes a braided shield which is interposed between said outer shield and said jacket.

* * * * *